US006840231B2

(12) United States Patent
Suzuki

(10) Patent No.: US 6,840,231 B2
(45) Date of Patent: Jan. 11, 2005

(54) RESERVOIR UNIT

(75) Inventor: Nobuo Suzuki, Ohbu (JP)

(73) Assignee: Aisan Kogyo Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 10/401,841

(22) Filed: Mar. 31, 2003

(65) Prior Publication Data

US 2003/0188724 A1 Oct. 9, 2003

(30) Foreign Application Priority Data

Apr. 3, 2002 (JP) ..... 2002-101251

(51) Int. Cl.[7] ..... F02M 37/10
(52) U.S. Cl. ..... 123/509; 137/565.17; 417/360
(58) Field of Search ..... 123/509; 137/565.17; 417/360

(56) References Cited

U.S. PATENT DOCUMENTS 6,293,770 B1 * 9/2001 Matsumoto et al. ..... 417/360
2003/0188722 A1 * 10/2003 Oku et al. ..... 123/509
2003/0188786 A1 * 10/2003 Toki et al. ..... 137/565.34

FOREIGN PATENT DOCUMENTS

JP 3-105054 * 5/1991 ..... F02M/37/22

* cited by examiner

*Primary Examiner*—Andrew M. Dolinar
(74) *Attorney, Agent, or Firm*—Stevens, Davis, Miller & Mosher, LLP

(57) ABSTRACT

In a reservoir unit installed in a fuel tank, in order to reduce noise generated from the engaging faces between guide rails extending from a plate-shaped portion of an upper subunit, fixed to the top face of the fuel tank, to a lower subunit, and slots provided in a reservoir in the lower subunit, a reservoir is configured of an upper subunit, a lower subunit and an elastic member, wherein the upper subunit is provided with a plate-shaped portion to block an opening formed in the fuel tank and guide rails extending from that plate-shaped portion to the bottom of the fuel tank; and slots and to slidably accept those guide rails are integrally formed with a reservoir. A metal plate intervenes between at least one position of the engaging face of the inner circumference of each slot and a guide rail, and the guide rails are formed in a flat plate shape, with slits extending upward from the lower part being formed at the tip of each.

6 Claims, 9 Drawing Sheets

RESERVOIR UNIT

BACKGROUND OF THE INVENTION

1. Field of the Invention

The present invention relates to a structure in which a reservoir unit is fitted within a fuel tank.

2. Description of the Related Art

A fuel tank of a motor vehicle requires a structure for gathering a small quantity of remaining fuel around the suction filter of the fuel pump so that, even if the quantity of the fuel remaining in the fuel tank has become very small, the suction filter of the fuel pump may not be exposed out of the fuel. Previously, as it was the usual practice to form the fuel tank of steel sheets, a fuel tank in which a sub-tank was formed around the suction filter of the fuel pump was manufactured by welding steel sheets formed into a sub-tank.

A resin-built fuel tank is beginning to be used in motor vehicles and the like. A resin-built fuel tank is usually manufactured by blow-molding synthetic resin material. In this case it is difficult to form a sub-tank in a resin-built fuel tank. In view of this difficulty, an opening is formed in the top face of the resin-built fuel tank, and that opening is utilized for arranging a reservoir unit in the fuel tank.

A fuel tank is deformed dependent on variations in atmospheric temperature and in the quantity of fuel within, and accordingly the distance between its top and bottom varies. The suction filter of the fuel pump needs to be maintained in a position near the bottom of the fuel tank correspondingly to the deformation of the fuel tank.

To meet this need, the reservoir unit is configured of an upper subunit, a lower subunit and an elastic member. The upper subunit is provided with a plate-shaped portion to block the opening formed in the top face of the fuel tank. The lower subunit is provided with a resin-built reservoir, a fuel filter accommodated in the reservoir and a fuel pump also accommodated in the reservoir. To the plate-shaped portion of the upper subunit are fixed stainless steel shafts extending toward the bottom of the fuel tank as guide rails. Slots to slidably accept the stainless steel shafts are molded integrally with the reservoir of the lower subunit. The elastic member, positioned between the upper subunit and the lower subunit, presses the lower subunit toward the bottom of the fuel tank.

In this structure, the distance between the upper subunit and the lower subunit varies following the deformation of the fuel tank and the consequent variation in the distance between its top and bottom. The suction filter of the fuel pump is maintained near the inner bottom of the fuel tank to match the deformation of the fuel tank.

In a reservoir unit according to the related art, when a large acceleration or deceleration is applied to the fuel tank, large opposite forces work between the lower subunit and the fuel tank in the accelerating and deceleration directions. If these forces become too strong, the plate-shaped portion linked to the lower subunit and fixed to the fuel tank is destroyed to break the air-tightness of the fuel tank.

In order to solve this problem, the present inventor conceived an idea of integrally molding the plate-shaped portion of the upper subunit and the guide rails of resin. Since integrally molding the plate-shaped portion of the upper subunit and the guide rails of resin results in destruction of the guide rails before the plate-shaped portion of the upper subunit would be destroyed to break the air-tightness of the fuel tank, no more force works on the plate-shaped portion of the upper subunit. Therefore, integrally molding the plate-shaped portion of the upper subunit and the guide rails of resin serves to prevent destruction of the plate-shaped portion of the upper subunit and the resultant breaking of the air-tightness of the fuel tank.

However, integral formation of the guide rails of resin causes, when the guide rails slide along the slots in the resin-built lower subunit, the resin-built guide rails and the resin-surrounded slots to come into friction with each other to give rise to squeaking noise, which means a problem of causing discomfort to the passengers of the motor vehicle, within which quietness is required.

That is to say, although integral formation of the guide rails of resin can prevent destruction of the plate-shaped portion of the upper subunit and the resultant breaking of the air-tightness of the fuel tank, there arises the problem that the resin-built guide rails and the resin-surrounded slots come into friction with each other to give rise to squeaking noise. Therefore, an object of the present invention is to realize a technique by which the latter problem can be solved without sacrificing the former advantage.

SUMMARY OF THE INVENTION

According to a first aspect of the present invention, there is provided a reservoir unit to be installed in a fuel tank having an upper subunit and a lower subunit, wherein the upper subunit is provided with a plate-shaped portion to block an opening formed in the top face of the fuel tank and guide rails extending from that plate-shaped portion toward the bottom of the fuel tank, the two elements being integrally molded of resin; the lower subunit is provided with a resin-built reservoir, a fuel filter accommodated in the reservoir, and a fuel pump accommodated in the reservoir, slots to slidably accept the guide rails being integrally formed in the reservoir, and metal plates are arranged within the slots.

This configuration serves to solve the problem that the resin-built guide rails and the resin-surrounded slots come into friction with each other to give rise to squeaking noise. By having a metal plate intervene between at least one position of the contact face of the inner circumference of each slot and a guide rail, squeaking noise can be prevented from arising when the resin-built guide rails and the resin-surrounded slots slide in relation to each other.

According to a second aspect of the invention, there is provided a reservoir unit to be installed in a fuel tank having an upper subunit and a lower subunit, wherein the upper subunit is provided with a plate-shaped portion to block an opening formed in the top face of the fuel tank and guide rails extending from that plate-shaped portion toward the bottom of the fuel tank, the two elements being integrally molded of resin; the lower subunit is provided with a resin-built reservoir, a fuel filter accommodated in the reservoir, and a fuel pump accommodated in the reservoir, slots to slidably accept the guide rails being integrally formed in the reservoir, and each of the guide rails, which are formed in a flat plate shape, has at its tip slits extending upward from the lower part.

The presence of slits extending upward from the lower part at the tip of each guide rail serves to solve the problem that, when the resin-built guide rails and the resin-surrounded slots come into friction with each other, squeaking noise arises for an unknown reason.

According to a third aspect of the invention, there is provided a reservoir unit to be installed in a fuel tank having an upper subunit and a lower subunit, wherein the upper subunit is provided with a plate-shaped portion to block an opening formed in the top face of the fuel tank and guide rails extending from that plate-shaped portion toward the bottom of the fuel tank, the two elements being integrally molded of resin, the lower subunit is provided with a resin-built reservoir, a fuel filter accommodated in the reservoir, and a fuel pump accommodated in the reservoir, slots to slidably accept the guide rails being integrally formed in the reservoir, and metal plates are arranged within the slots and each of the guide rails, which are formed in a flat plate shape, has at its tip slits extending upward from the lower part.

In this case, both the effect of the metal plates to reduce the squeaking noise and the similar effect of the slits can be achieved, resulting in even more effective prevention of squeaking noise.

DESCRIPTION OF THE PREFERRED EMBODIMENTS

The following paragraphs enumerate principal features of the preferred embodiments of the present invention to be described below.

(Mode 1) Each of the guide rails extending from the upper subunit toward the lower subunit, which are formed in a flat plate shape, has a frail part in which a long hole is formed extending along the center line and at an end of this long hole toward the plate-shaped portion is formed a large hole to make both sides of it thinner.

(Mode 2) Each of the guide rails, which are formed in a flat plate shape, has at its tip slits extending upward.

(Mode 3) Metal plates are arranged inside the slots of the reservoir.

(Mode 4) The pair of guide rails extending from the upper subunit to the lower subunit are in substantially opposite positions to each other with the diameter in-between, and a spring to press the reservoir downward as the elastic member is arranged in a position about 90 degrees away from the rails.

[Embodiments]

A reservoir unit according to a first preferred embodiment of the present invention will now be described in detail with reference to FIG. 1.

Figure 1:
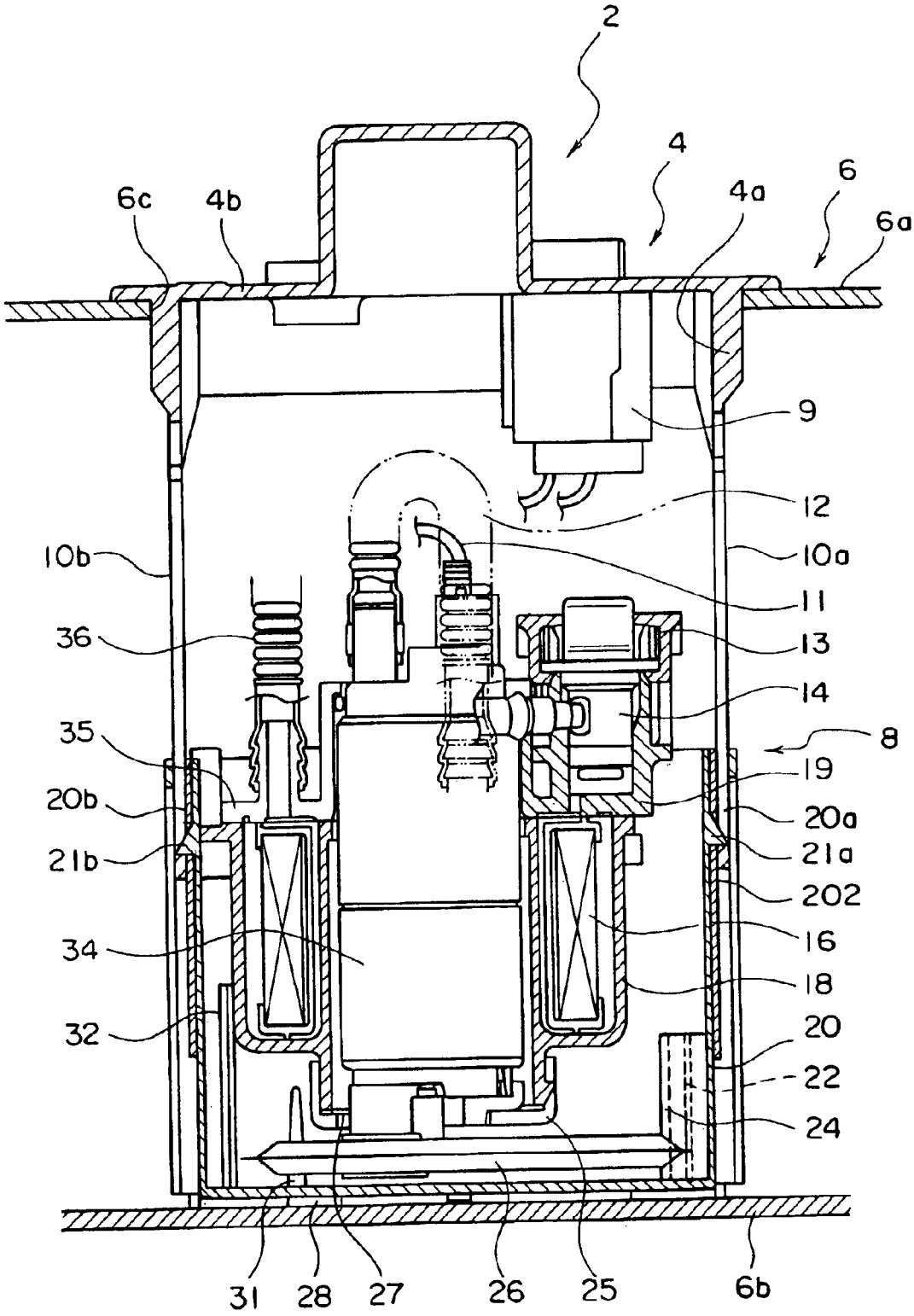
FIG. 1 is a schematic side view of a whole reservoir unit according to the present invention.

As shown in FIG. 1, a reservoir unit 2 of the embodiment comprises an upper subunit 4 and a lower subunit 8, and installed in a fuel tank 6 when it is used. The lower subunit 8 is provided with a reservoir 20 in a cylindrical shape having a bottom (i.e. shaped substantially like a glass), a primary filter 26, a fuel pump 34, a pressure regulator 14 and a secondary filter 16. The primary filter 26, the fuel pump 34, the pressure regulator 14 and the secondary filter 16 are accommodated in the reservoir 20 to be positioned, and constitute an assembly.

The primary filter 26, fuel pump 34, pressure regulator 14, secondary filter 16, reservoir 20 and upper subunit 4 will be described in detail below in this sequence.

Figure 4A:
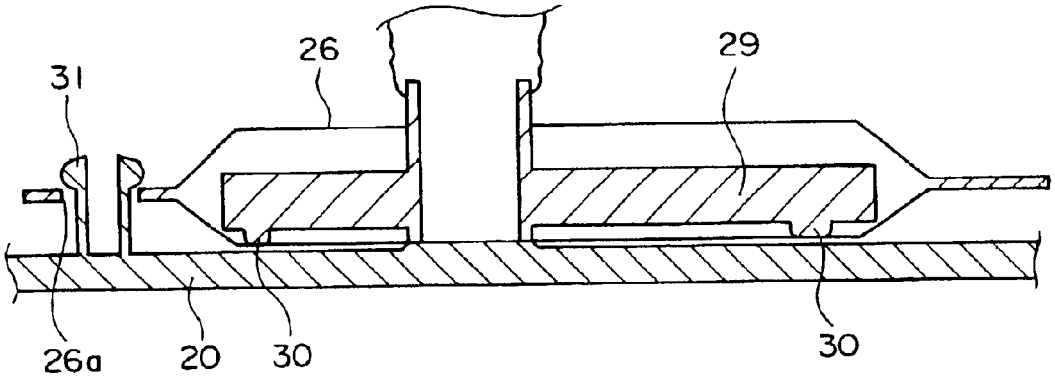
FIG. 4A is a sectional view of a primary filter.
Figure 4B:
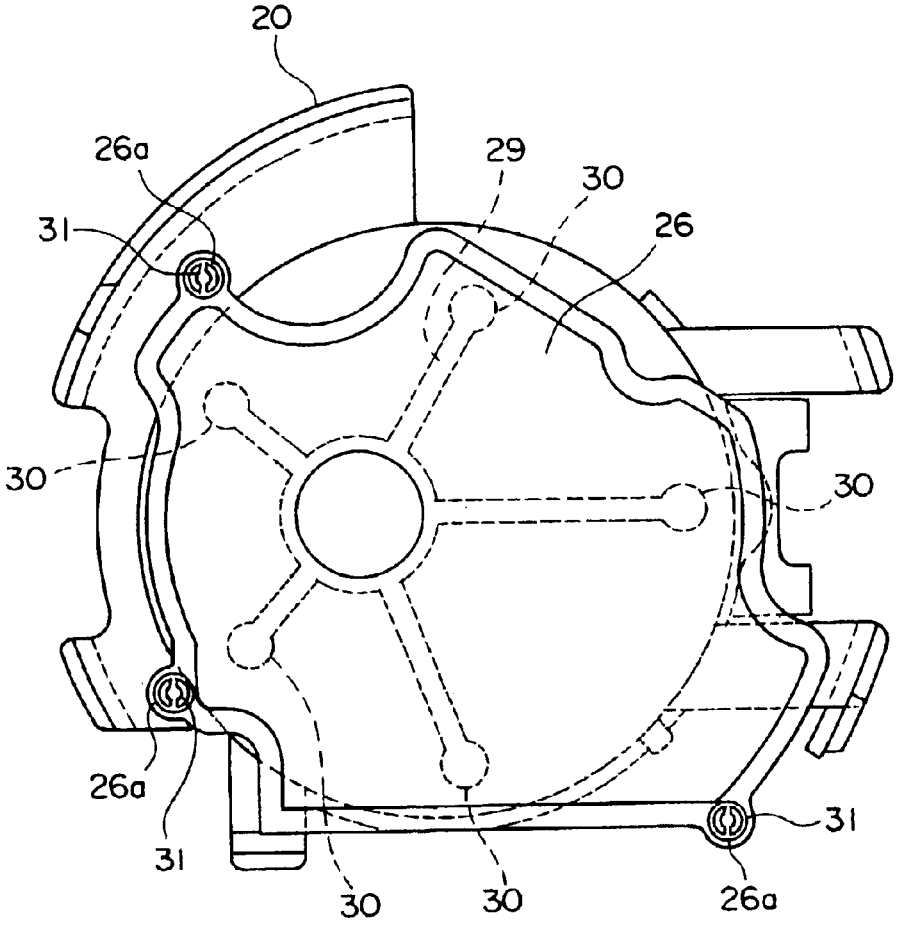
FIG. 4B is a plan view of the same.

The primary filter 26 is configured of a bag filter of fine-texture nylon and a resin-built frame inserted into and securing a certain volume within the bag. The inner space of the bag filter is continuous to the suction port of the fuel pump 34. The primary filter 26 is accommodated in the reservoir 20 and arranged along the inner bottom of the reservoir 20. As shown in FIGS. 4A and 4B, the frame is composed of a swelled portion 30 pressing a few parts of the bottom of the bag filter against the inner bottom of the reservoir 20, and a frame body 29 keeping the other parts of the bottom of the bag filter in a position slightly away from the bottom of the reservoir 20. This arrangement serves to secure spacing between the primary filter 26 and the inner bottom of the reservoir 20 to enable the whole filtering face to perform the filtering function.

On the circumference of the primary filter 26 are bored engaging holes 26*a* to fit snap fits 31 protruding upward from the inner bottom of the reservoir 20. Engagement of the engaging holes 26*a* with the snap fits 31 prevents the primary filter 26 from floating away from the inner bottom of the reservoir 20, thereby helping to keep it in a position along the inner bottom of the reservoir 20.

The meshes of the bag filter of fine-texture nylon, when exposed from the fuel, are clogged by the fuel as it surface tension works. As long as even a small part of the bag filter is soaked in the fuel, the fuel enters into the filter through the soaked part of the bag, and accordingly the bag filter can still absorb the fuel even if the remaining quantity of the fuel is so small that the top of the bag filter is exposed. Any foreign matter in the fuel is substantially removed by the primary filter 26, and the remainder is further removed by the secondary filter 16 to be elaborated upon afterwards. The fuel cleared of foreign matter by the primary filter 26 is sucked by the fuel pump.

As shown in FIG. 1, the fuel pump 34 is formed in a substantially vertical columnar shape, and has at its bottom a fuel suction pipe (not shown). To the fuel suction pipe (not shown) is connected the primary filter 26. At the top end of the fuel pump 34, there are provided an electrical connector 11 and a fuel discharge pipe 12.

The fuel pump 34, driven by being supplied with electricity through the electrical connector 11, sucks fuel in the reservoir 20 to be described afterwards from the primary filter 26, raises its pressure, and discharges it from the fuel discharge pipe 12.

To the fuel discharge pipe 12 is connected the pressure regulator 14. The pressure regulator 14 is a relief valve which, when the pressure in the fuel discharge pipe 12 surpasses a prescribed level, lets the fuel escape from the fuel discharge pipe 12 to keep the pressure within the fuel discharge pipe 12 at the prescribed level. It maintains the pressure of the fuel to be fed to the secondary filter 16, and eventually that of the fuel fed to the internal combustion engine, at the prescribed level. The fuel having escaped from the pressure regulator 14 is guided by piping (not shown in FIG. 1) into a jet pump 40 to be described afterwards. The pressure regulator 14 is accommodated in the pressure regulator fitting part 19 of a filter cover 35 to be elaborated upon afterwards, and is supported in a state of being prevented from coming off by the assembling of its cap 13 into the pressure regulator fitting part 19 of the filter cover 35.

Around the fuel pump 34 is formed a doughnut-shaped vessel 18, in which the secondary filter 16, also doughnut-shaped, is accommodated and covered by the filter cover 35 which blocks the top opening of the doughnut-shaped vessel 18. The doughnut-shaped vessel 18 and the filter cover 35 are molded resin items. The doughnut-shaped vessel 18 is bisected by the doughnut-shaped secondary filter 16 into an inner chamber and an outer chamber, and the fuel discharge pipe 12 leads to the outer chamber of the doughnut-shaped vessel 18. To the inner chamber of the doughnut-shaped vessel 18 leads a fuel feed pipe 36. The fuel delivered from the fuel pump 34 passes the secondary filter 16 from the outer chamber of the doughnut-shaped vessel 18 to reach the inner chamber of the doughnut-shaped vessel 18 and enters the fuel feed pipe 36. The fuel feed pipe 36 penetrates the upper subunit 4 and extends out of the fuel tank 6. In this embodiment according to the invention, the fuel feed pipe 36 is connected to an injector via a delivery pipe (neither shown), and supplies the injector with fuel which is raised in pressure by the fuel pump 34, regulated by the pressure regulator 14 to a constant pressure level, and cleared of foreign matter by the primary filter 26 and the secondary filter 16. Into the hollow space within the doughnut-shaped vessel 18 is inserted the fuel pump 34 from its bottom opening. Assembling of a fitting stay 25 to the bottom of the doughnut-shaped vessel 18 results in supporting of the fuel pump 34 in a state in which the pump is prevented from coming off. A cushion rubber 27 intervenes between the fuel pump 34 and the fitting stay 25 to elastically support the fuel pump 34.

Next will be described the upper subunit 4 with reference to FIG. 1 and FIGS. 5A and 5B. The upper subunit 4, which is a molded resin item, is provided with a substantially round disk portion 4*b* fixed to the top face 6*a* of the fuel tank 6 to block the opening of the fuel tank 6, a cylindrical wall 4*a* protruding from the bottom face of the disk portion 4*b*, and a pair of guide rails 10*a* and 10*b* extending downwards from the cylindrical wall 4*a*. The cylindrical wall 4*a* can be fit into the fitting holes 6*c* of the fuel tank 6. As shown in FIG. 1, fitting of the upper subunit 4 to block the fitting holes 6*c* of the fuel tank 6 results in arrangement and positioning of the reservoir unit 2 in the fuel tank 6. The outer circumference of the upper subunit 4 is mounted over the edges of the fitting holes 6*c* of the fuel tank 6 via a seal gasket (not shown), and fastened over the fitting holes 6*c* of the fuel tank 6 with bolts (not shown). This results in fixing of the upper subunit 4 to the fuel tank 6.

The upper subunit 4 has an electrical connector 9 provided with terminals vertically penetrating the disk portion 4*b*. To the electrical connector 9 of the upper subunit 4 is electrically connected an electrical connector 11 of the fuel pump 34 on the lower side of the upper subunit 4. The electrical connector 9 of the upper subunit 4 is also electrically connected on the top side of the upper subunit 4 to a connector for power feed (not shown).

Figure 5A:
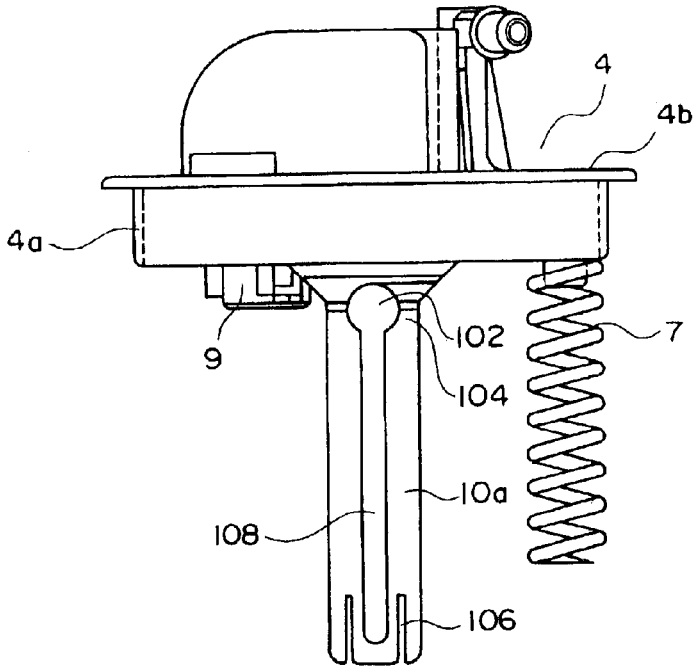
FIG. 5A is a front view of an upper subunit.
Figure 5B:
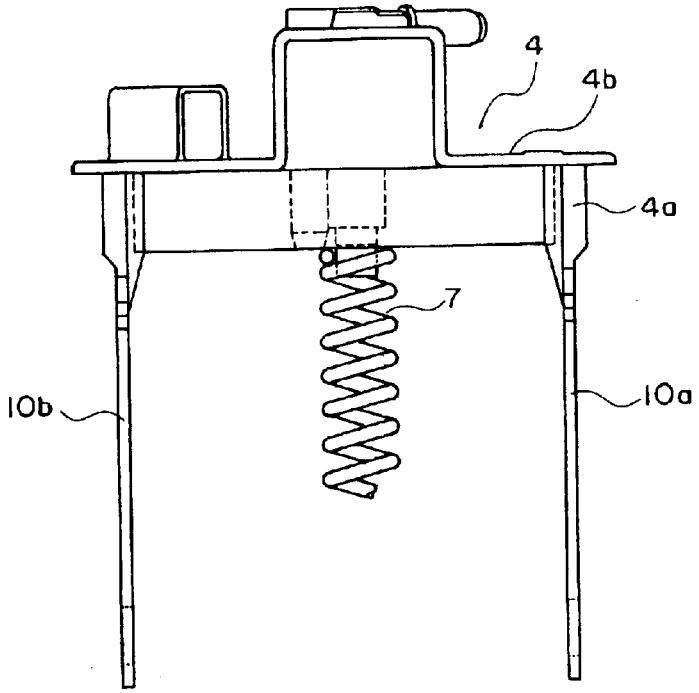
FIG. 5B is a side view of the same.

As well illustrated in FIGS. 5A and 5B, the pair of guide rails 10*a* and 10*b* extend from the cylindrical wall 4*a* of the upper subunit 4. Each of the guide rails 10*a* and 10*b* is formed in a flat plate shape. A long hole 108 is formed along the center line of each of the guide rails 10*a* and 10*b*. At the top end of the long hole 108 is formed a large hole 102, and the two sides of the large hole 102 constitute a frail portion 104. At the tip of each of the guide rails 10*a* and 10*b* are formed slits 106 extending upwards from the lower end. The slits 106 are formed on both sides of the long hole 108.

Figure 6:
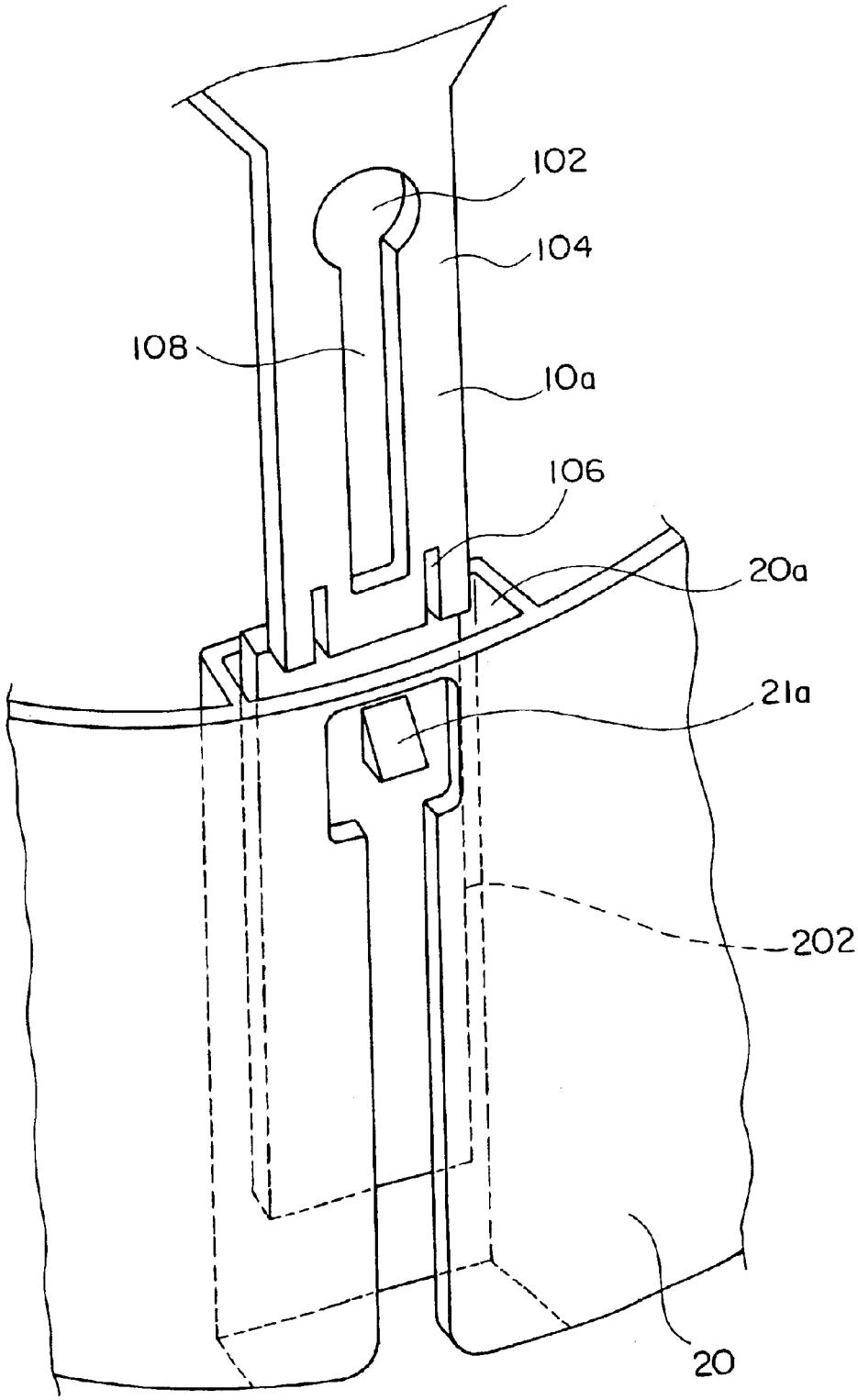
FIG. 6 is a perspective view showing how guide rails and a sheath-shaped slot engage with each other.
Figure 7:
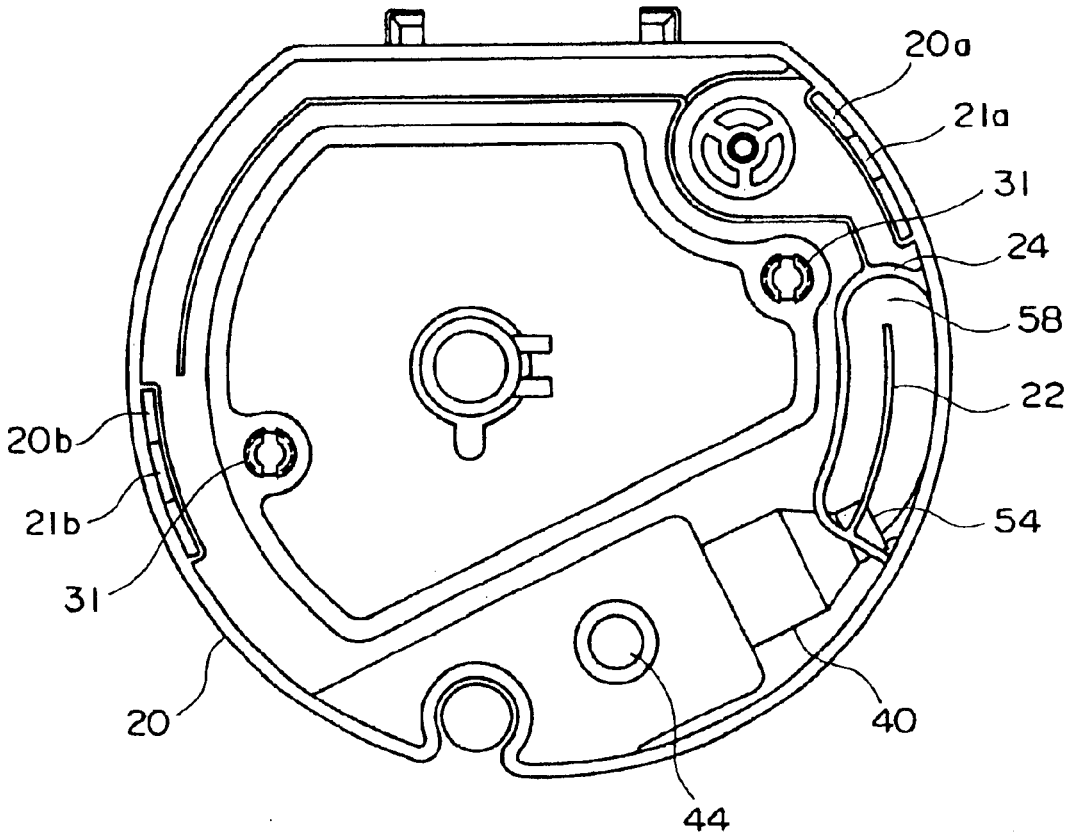
FIG. 7 is a plan view of a reservoir according to a second preferred embodiment of the invention.
Figure 8:
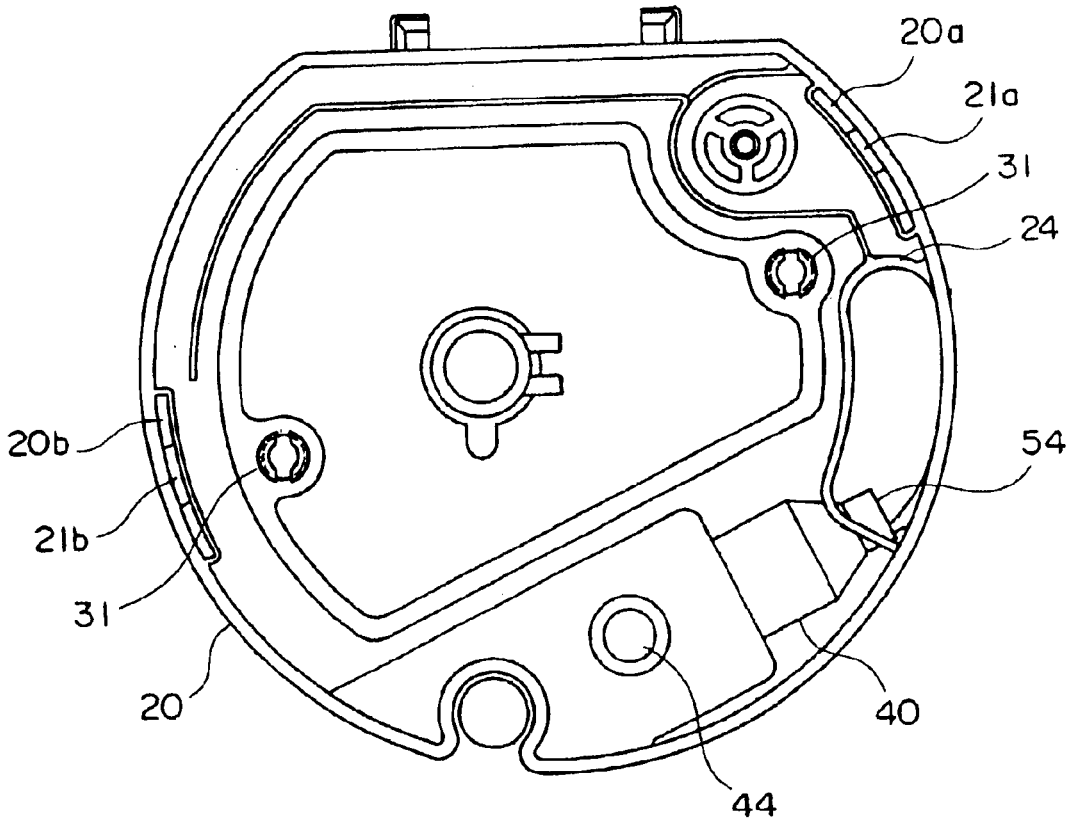
FIG. 8 is a plan view of a reservoir according to a third preferred embodiment of the invention.
Figure 9:
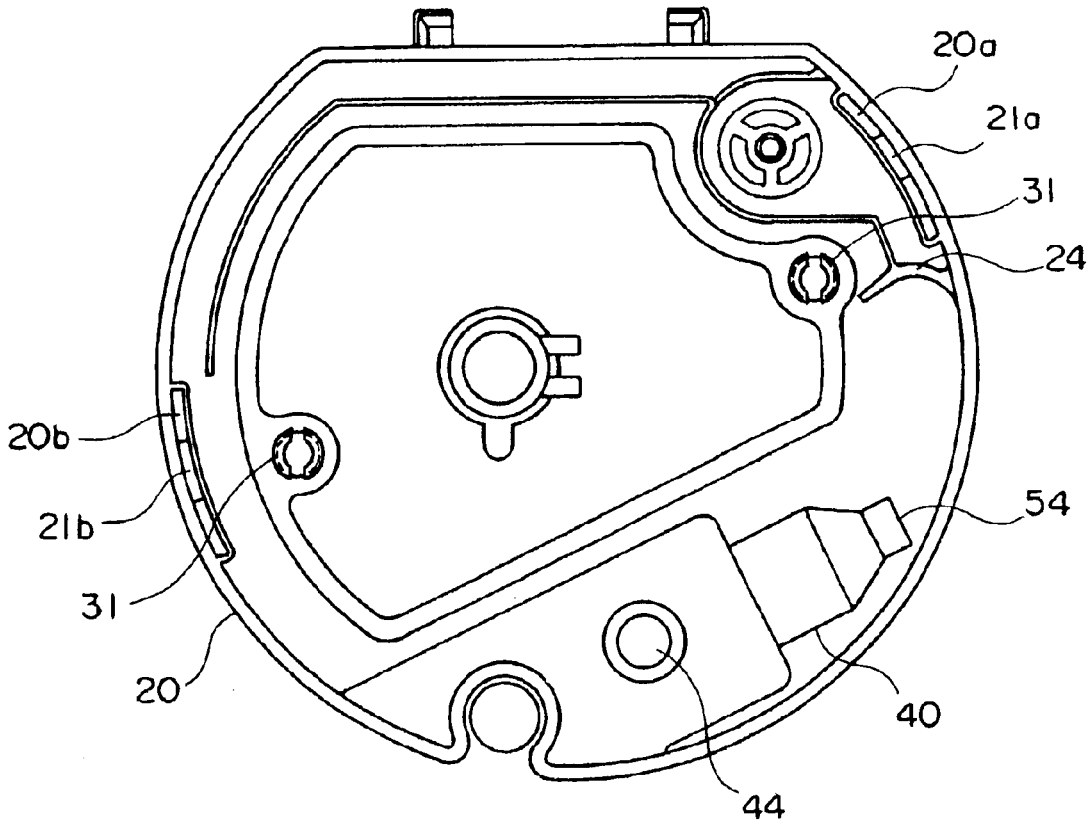
FIG. 9 is a plan view of a reservoir according to a fourth preferred embodiment of the invention.

As well illustrated in FIG. 6, the reservoir 20 has sheath-shaped slots 20*a* and 20*b* to accept the pair of guide rails 10*a* and 10*b*, and moves toward or away from the upper subunit 4 along the pair of guide rails 10*a* and 10*b*. Within the sheath-shaped slots 20*a* and 20*b* are provided tapered projections 21*a* and 21*b* on which the guide rails 10*a* and 10*b* are slidable in only one direction. When the upper subunit 4 and the lower subunit 8 are assembled, the guide rails 10*a* and 10*b* are elastically deformed to ride over the tapered projections 21*a* and 21*b*. During normal use, the tapered projections 21*a* and 21*b* are engaged with the ends of the long holes 108 of the guide rails 10*a* and 10*b* so that the upper subunit 4 and the lower subunit 8 may not sever from each other.

Inside the sheath-shaped slots 20*a* and 20*b* to accept the guide rails 10*a* and 10*b* are arranged metal plates 202. They can prevent, when the guide rails 10*a* and 10*b* and the slots 20*a* and 20*b* on the reservoir side to accept them slide relative to each other, squeaking noise or the like from arising. There is no particular limitation to the material of the metal plates 202, but stainless steel, which is resistant to corrosion, has been selected for this embodiment of the invention.

Between the upper subunit 4 and the lower subunit 8 is provided a compression spring 7 (not shown in FIG. 1) as the elastic member, and the spring 7 presses the lower subunit 8 toward the bottom 6*b* of the fuel tank 6. The fuel tank 6 is blow-molded of resin, and is subject to deformation by a change in the quantity of remaining fuel and/or a change in atmospheric temperature. Therefore, the lower subunit 8 is pressed all the time toward the bottom 6*b* of the fuel tank 6 correspondingly to the deformation of the fuel tank 6.

When a vehement acceleration works on the fuel tank 6, the reservoir unit 2 tends to be displaced relative to the fuel tank 6. If the guide rails 10*a* and 10*b* are firm then, the disk portion 4*b* of the upper subunit 4 may be destroyed when the reservoir unit 2 is displaced relative to the fuel tank 6. The disk portion 4*b* of the upper subunit 4 is especially subject to destruction at the roots of the guide rails 10*a* and 10*b*. When the disk portion 4*b* is destroyed, the fuel may escape from the fuel tank 6. In the embodiment, as the frail portion 104 is formed in the guide rails 10*a* and 10*b*, even if a vehement acceleration works on the fuel tank 6 and the reservoir unit 2 is displaced relative to the fuel tank 6, the frail portion 104 will be destroyed first, and therefore the disk portion 4*b* will not be. As there is the frail portion 104, it can prevent the disk portion 4*b* from being damaged, so as to leak the fuel. To add, even if the frail portion 104 is destroyed, the fuel pump can continue to work because electric cables to drive the fuel pump and the hose to feed fuel remain connected. Thus it is possible to continue to feed fuel to the engine, and thereby enabling the motor vehicle to run as required for ensuring safety.

Figure 2A:
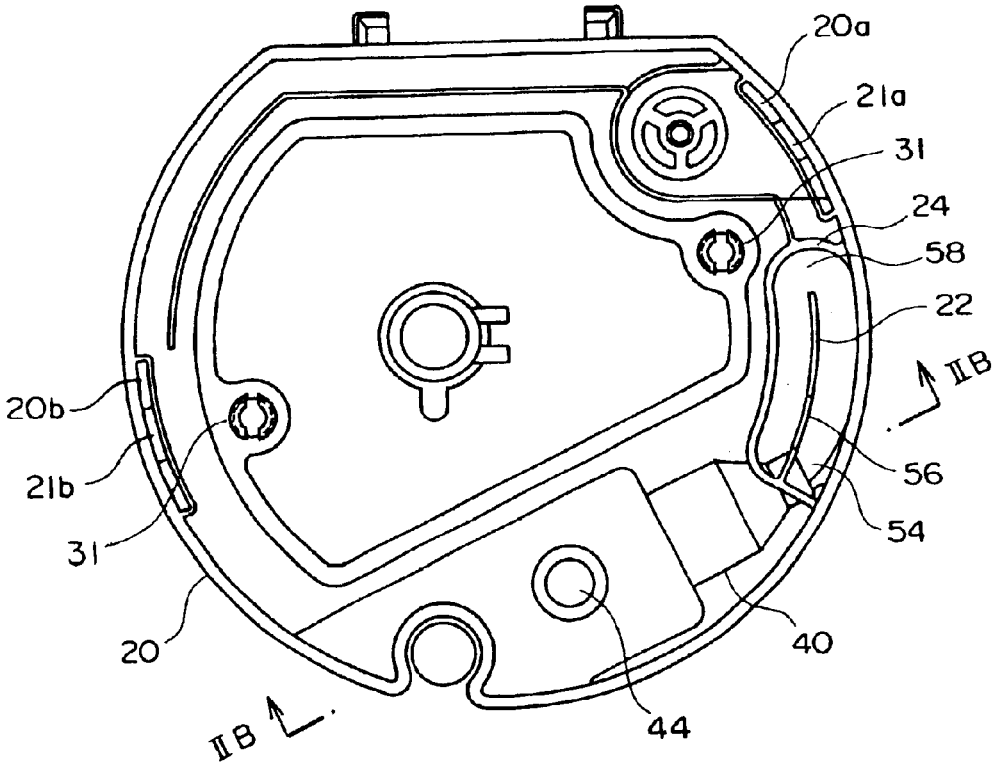
FIG. 2A is a plan view of a reservoir according to a first preferred embodiment of the invention.

FIG. 2A shows a plan view of the reservoir 20, wherein the positions of the snap fits 31 are altered from those shown in FIGS. 4A and 4B. Two snap fits 31 are sufficient to keep the primary filter 26 arranged along the bottom of the reservoir 20.

Figure 2B:
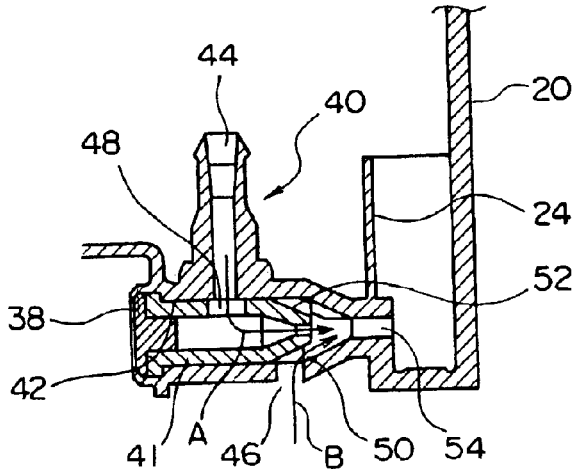
FIG. 2B is a sectional view taken along a center line (line IIB—IIB) of a jet pump in FIG. 2A.

FIG. 2B shows a sectional view of the jet pump 40 taken along the center line (a line IIB—IIB) shown in FIG. 2A. In the bottom of the reservoir 20, which is composed of a molded item of resin, is formed a concave 42 to accept a jet pump body 41 of the jet pump 40, and openings 44 and 46 communicating to the concave are formed, penetrating the wall of the reservoir 20. The opening 44 is fitted with a hose to connect the pressure regulator 14 and the opening 44, so that returning fuel from the pressure regulator 14 can be guided to the opening 44. The opening 46 opens into the gap between the bottom of the reservoir 20 and the bottom 6*b* of the fuel tank 6. As shown in FIG. 1, a slight spacing is secured between the bottom of the reservoir 20 and the bottom 6*b* of the fuel tank 6 by projections 28.

The jet pump body 41 is accommodated in the concave 42, and the subsequent fixing of a plug 38 to the reservoir 20 causes the jet pump body 41 to be fixed to the reservoir 20. The jet pump body 41 is provided with an opening 48 to accept returning fuel from the pressure regulator 14, a passage 50 for accepting fuel from outside the reservoir 20, and a venturi tube 52. When the jet pump body 41 is fixed to the reservoir 20, the opening 44 becomes continuous to the opening 48, and the opening 46, to the passage 50.

As returning fuel from the pressure regulator 14 is guided to the opening 44, that fuel passes through the venturi tube 52 of the jet pump 40 as indicated by arrow A. As the flow rate of returning fuel jetting out of the venturi tube 52 is fast, a negative pressure is generated in the downstream part of the venturi tube 52. This negative pressure causes, as indicated by arrow B, fuel outside the reservoir 20 to pass through the opening 46 and the passage 50 to be sucked by the jet pump 40 and discharged out of its discharge port 54.

From the discharge port 54 of the jet pump 40 are discharged returning fuel from the pressure regulator 14 and fuel sucked from outside the reservoir 20. Utilizing the flow velocity of returning fuel from the pressure regulator 14, the jet pump 40 introduces fuel outside the reservoir 20 into the reservoir 20.

The fuel discharged from the discharge port 54 of the jet pump 40 contains many bubbles. When it is powerfully discharged into the reservoir 20, the inner space of the reservoir may be filled with fuel containing many bubbles. If the reservoir 20 is filled with fuel containing bubbles, the fuel pump 34 may take in many bubbles and become vapor-locked, or the fuel containing bubbles may be supplied to the injector to disable the injector to inject the intended quantity of fuel.

In this embodiment according to the invention, in order to prevent the reservoir 20 from being filled with fuel containing bubbles, a wall 24 fully surrounding the discharge port 54 of the jet pump 40 is molded integrally with the resin-built reservoir 20. Thus, the flow delivered from the jet pump 40 is discharged into the closed space surrounded by the full-circle wall 24, the fuel in that closed space is cleared of the bubbles, and the fuel is moved outside the wall 24 after it is cleared of the bubbles, thereby preventing the presence of many bubbles in the fuel within the reservoir 20 outside the wall 24.

As shown in FIG. 2A, the wall 24 fully surrounds the discharge port 54 of the jet pump 40. Its height is less than that of the side wall of the reservoir 20. There is no particular limitation to the shape of the wall 24, but it preferably should have no corner in its planar view, i.e., be substantially oval or substantially circular, shaped like a bean, because any corner might invite concentration of bubbles in the fuel in that corner.

A partition wall 22 is formed at a central part in the full-circle wall 24, so configured that fuel delivered from the jet pump 40 flow round the partition wall 22. The fuel delivered from the jet pump 40 is discharged along the partition wall 22.

Figure 3A:
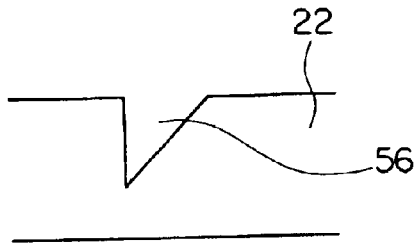
FIGS. 3A through 3C are front views of one example and its modified versions of a partition wall according to the first embodiment of the invention.
Figure 3B:
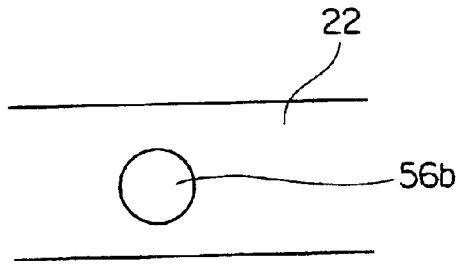
Figure 3C:
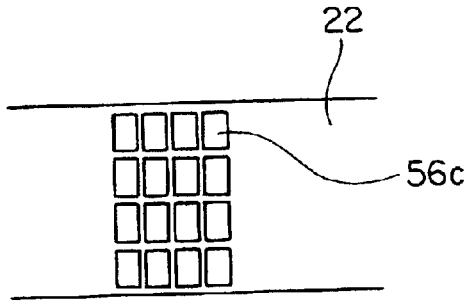

Clearances 56 and 58 are secured between the two sides of the partition wall 22 and the full-circle wall 24. The clearance 56 can be formed by notching a part of the wall 22 as shown in FIG. 3A. It is sufficient for the clearance 56 to permit the delivered flow to turn round the partition wall 22 a plurality of times, any of the hole-shaped clearance 56*b* shown in FIG. 3B, a meshed clearance 56*c* as shown in FIG. 3C or the like may be applied as appropriate.

Incidentally, although the fuel tank in the above embodiments is made of resin, the tank may be made of the conventional material.

While the invention has been described with reference to preferred embodiments thereof, they are presented as mere examples, but nothing to limit the scope of claims for the patent. Various modifications and alterations of the specific embodiments described above can be included within the spirit and scope of the following claims.

Further, the technical elements described in this specification or illustrated in the accompanying drawings can prove technically useful either by themselves or in various combinations, but not limited to the combinations in the claims contained in the application. The aspects of the art described in this specification or illustrated in the accompanying drawings achieve a plurality of objects at the same time, and achieving any one of those objects can be technically useful in itself.

The reservoir unit according to the invention can minimize noise generating from the fuel tank of the motor vehicle, within which quietness is required, and thereby solve the problem that the generated noise causes discomfort to the passengers of the vehicle.

What is claimed is:

1. A reservoir unit to be installed in a fuel tank having an upper subunit and a lower subunit, wherein:

the upper subunit is provided with a plate-shaped portion to block an opening formed in a top face of the fuel tank and guide rails extending from that plate-shaped portion toward the bottom of the fuel tank, said plate-shaped portion and guide rails being integrally molded of resin, the lower subunit is provided with a resin-built reservoir, a fuel filter accommodated in the reservoir, and a fuel pump accommodated in the reservoir, slots to slidably accept said guide rails being integrally formed in the reservoir, and metal plates are arranged within said slots.

2. A reservoir unit to be installed in a fuel tank having an upper subunit and a lower subunit, wherein:

the upper subunit is provided with a plate-shaped portion to block an opening formed in a top face of the fuel tank and guide rails extending from that plate-shaped portion toward the bottom of the fuel tank, said plate-shaped portion and guide rails being integrally molded of resin, the lower subunit is provided with a resin-built reservoir, a fuel filter accommodated in the reservoir, and a fuel pump accommodated in the reservoir, slots to slidably accept said guide rails being integrally formed in the reservoir, and each of the guide rails, which are formed in a flat plate shape, has at its tip slits extending upward from the lower part.

3. A reservoir unit to be installed in a fuel tank having an upper subunit and a lower subunit, wherein:

the upper subunit is provided with a plate-shaped portion to block an opening formed in a top face of the fuel tank and guide rails extending from that plate-shaped portion toward the bottom of the fuel tank, said plate-shaped portion and guide rails being integrally molded of resin, the lower subunit is provided with a resin-built reservoir, a fuel filter accommodated in the reservoir, and a fuel pump accommodated in the reservoir, slots to slidably accept said guide rails being integrally formed in the reservoir, and metal plates are arranged within said slots and each of the guide rails, which are formed in a flat plate shape, has at its tip slits extending upward from the lower part.

4. A reservoir unit as claimed in claim 1, wherein said fuel tank is made of resin.

5. A reservoir unit as claimed in claim 2, wherein said fuel tank is made of resin.

6. A reservoir unit as claimed in claim 3, wherein said fuel tank is made of resin.

* * * * *